US007036923B2

(12) United States Patent
Takagi et al.

(10) Patent No.: US 7,036,923 B2
(45) Date of Patent: May 2, 2006

(54) IMAGE RECORDING APPARATUS

(75) Inventors: Osamu Takagi, Nagoya (JP); Susumu Kuzuya, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 108 days.

(21) Appl. No.: 10/879,025

(22) Filed: Jun. 30, 2004

(65) Prior Publication Data

US 2005/0018029 A1 Jan. 27, 2005

(30) Foreign Application Priority Data

Jun. 30, 2003 (JP) ..... 2003-188994

(51) Int. Cl.
*B41J 15/00* (2006.01)

(52) U.S. Cl. ..... 347/104; 400/611; 400/621; 400/635; 226/170

(58) Field of Classification Search ..... None
See application file for complete search history.

(56) References Cited

U.S. PATENT DOCUMENTS 1,927,585 A * 9/1933 Fischer et al. ..... 271/272
5,170,183 A * 12/1992 Hirabayashi et al. ..... 346/134
5,646,668 A * 7/1997 Fujioka et al. ..... 347/104
5,808,646 A * 9/1998 Kitahara et al. ..... 347/104
5,808,647 A * 9/1998 Kurata et al. ..... 347/104
6,005,593 A * 12/1999 Yoshinaga et al. ..... 346/134
6,550,907 B1 * 4/2003 Uchida ..... 347/104
2004/0114019 A1 * 6/2004 Nakashima ..... 347/104

FOREIGN PATENT DOCUMENTS

JP A 10-139239 5/1998

* cited by examiner

*Primary Examiner*—Andrew Hirshfeld
*Assistant Examiner*—Jill E. Culler
(74) *Attorney, Agent, or Firm*—Oliff & Berridge, PLC

(57) ABSTRACT

A conveyor unit in an image recording apparatus can convey a record medium, being unwound from a roll, in either of a first direction in which the roll is unwound and a second direction reverse to the first direction. The image recording apparatus includes first and second contact mechanisms capable of bringing the record medium into close contact with a conveyor member at positions distant in the respective first and second directions from an image recording position where an image recording head records an image on the record medium. The first contact mechanism brings the record medium, being conveyed in the first direction, into close contact with the conveyor member. The second contact mechanism brings a part of the record medium, being conveyed in the second direction, into close contact with the conveyor member, which part was beyond the conveyor member in the first direction when the conveyance direction of the record medium by the conveyor member was switched from the first direction to the second direction.

28 Claims, 9 Drawing Sheets

IMAGE RECORDING APPARATUS

BACKGROUND OF THE INVENTION

1. Field of the Invention

The present invention relates to an image recording apparatus for recording an image on a record medium being unwound from a roll.

2. Description of Related Art

As an image recording apparatus, an inkjet printer is known that has inkjet heads in each of which a large number of nozzles are formed. In the inkjet printer, ink is ejected from the nozzles of each head onto a record medium being conveyed, to record a desired image on the record medium. As the record medium for the inkjet printer, a cut sheet of paper cut in advance into a predetermined length is generally used. However, attendant upon the extension of the range of use of printers, not only such cut sheets of paper but also long papers are used for printers.

In general, a long paper is wound into a roll, which is rotatably supported by a roll supporter in a printer, for example, as disclosed in JP-A-10-139239. A portion near the leading edge of the paper being unwound from the roll is pinched by a pair of pickup rollers. In this state, the rollers are rotated. Thereby, the paper being unwound from the roll is conveyed for heads. Hereinafter, the direction in which the paper being unwound from the roll is advanced will be referred to as forward, and the reverse direction will be referred to as backward.

The paper is put on a conveyor belt of a conveyor unit and conveyed by the conveyor belt. An image is recorded on the paper at the position opposite to the nozzles of the heads. Thereafter, the paper is cut by a cutter. The part of the paper being ahead of the cutting position by the cutter is thereby cut off into a separate cut sheet discontinuous from the roll, and thereafter discharged out of the printer. On the other hand, the part of the paper in the rear of the cutting position by the cutter, on which part no image has been recorded, can be used for image recording in the next printing operation. Therefore, the part of the paper is conveyed backward to be rewound onto the roll.

The paper being unwound from the roll is apt to curve due to its tendency to curl as an aftereffect of winding. In particular, the vicinity of the leading edge of the paper is apt to greatly curve because the leading edge is an unrestrained free end.

In an inkjet printer having a construction in which a paper is put on a conveyor belt to convey, the paper being conveyed can be in close contact with the conveyor belt by the adhesion of the conveyor belt or the like so that the paper can not separate from the conveyor belt. However, the vicinity of the leading edge of the paper immediately after being cut by a cutter, is at the position of the cutter, distant forward from the conveyor belt, where the vicinity of the leading edge of the paper has been peeled off the conveyor belt. Thus, the vicinity of the leading edge of the paper is apt to curve upward due to its tendency to curl. Under this condition, if the paper is rewound as described above, the curved portion of the paper may come into contact with a head and as a result, ink may adhere to the paper.

SUMMARY OF THE INVENTION

An object of the present invention is to provide an image recording apparatus wherein a record medium can be prevented from coming into contact with any image recording head, in particular, when the record medium is conveyed in the reverse direction to the direction in which a roll is unwound.

According to an aspect of the present invention, an image recording apparatus comprises a roll supporter, a conveyor unit, an image recording heads an image recording controller, a first contact mechanisms and a second contact mechanism. The roll supporter rotatably supports a roll into which a long record medium has been wound. The conveyor unit comprises an adhesive conveyor member on which the record medium being unwound from the roll is put. The conveyor unit can convey the record medium put on the conveyor member in either of a first direction in which the roll is unwound and a second direction reverse to the first direction. The image recording head records an image on the record medium put on the conveyor member. The image recording controller controls the image recording head to record the image on the record medium being conveyed in the first direction. The first contact mechanism can bring the record medium into close contact with the conveyor member at a position distant in the second direction from an image recording position where the image recording head records the image on the record medium. The second contact mechanism can bring the record medium into close contact with the conveyor member at a position distant in the first direction from the image recording position. The first contact mechanism brings the record medium, being conveyed in the first direction, into close contact with the conveyor member. The second contact mechanism brings a part of the record medium, being conveyed in the second direction, into close contact with the conveyor member, which part was beyond the conveyor member in the first direction when the conveyance direction of the record medium by the conveyor member was switched from the first direction to the second direction.

According to the invention, when image recording is performed on the record medium being conveyed in the first direction, because the first contact mechanism brings the record medium into close contact with the conveyor member, good image recording can be achieved. On the other hand, when the record medium is conveyed in the second direction reverse to the first direction after image recording and, for example, being cut, the second contact mechanism can bring the portion of the record medium near its leading edge, which is apt to curve upward due to its tendency to curl, into close contact with the conveyor member. Thus, the record medium is prevented from coming into contact with the image recording head.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENT

Hereinafter, a preferred embodiment of the present invention will be described with reference to drawings.

First, the whole construction of an inkjet printer according to the embodiment of the present invention will be described with reference to FIGS. 1 and 2. In the below description, the direction indicated by an arrow A in FIG. 1, in which a roll 500 is unwound, will be referred to as forward, and the reverse direction indicated by an arrow B will be referred to as backward.

Figure 1:
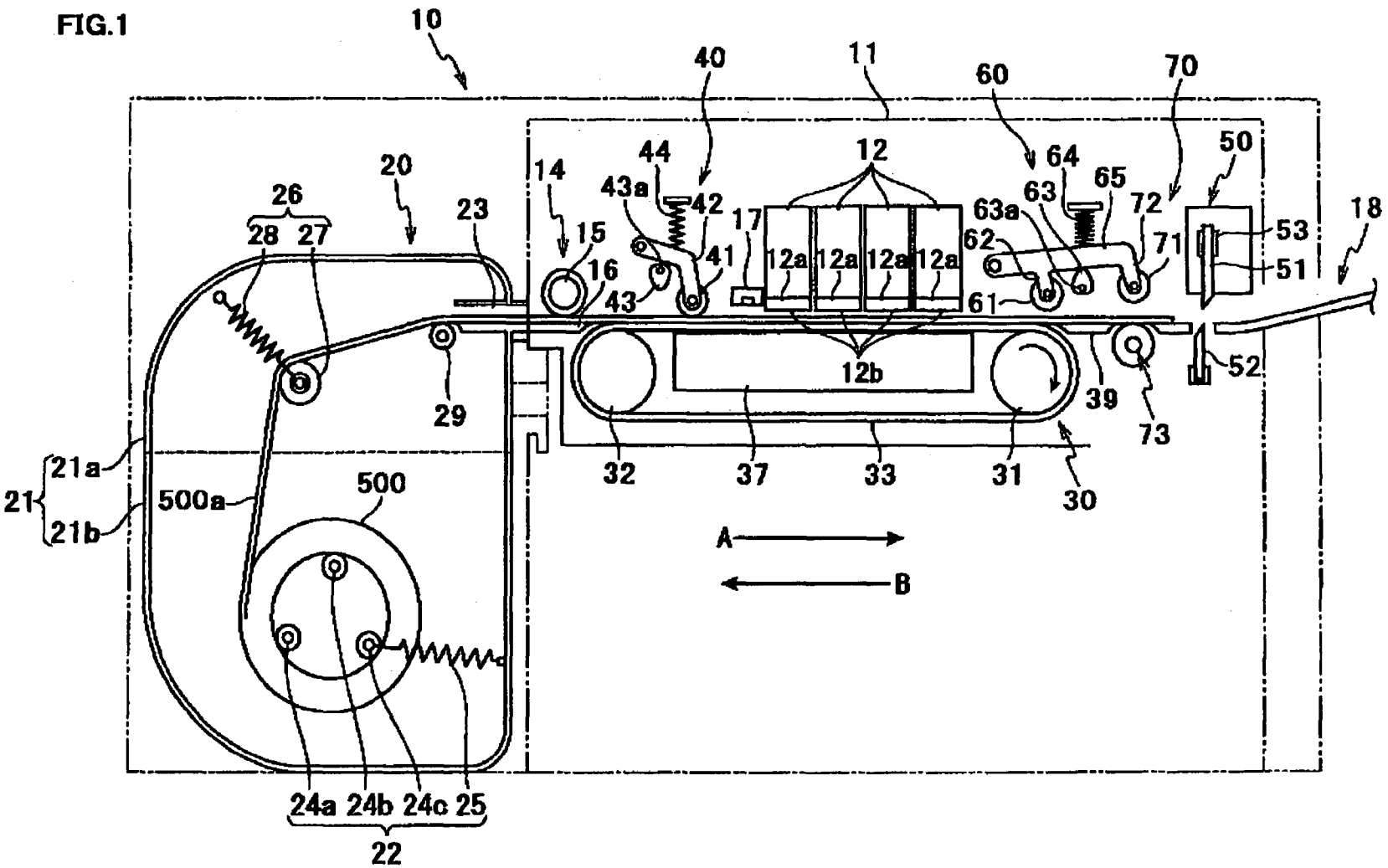
FIG. 1 is a front view showing the whole construction of an inkjet printer according to an embodiment of the present invention.

As shown in FIG. 1, the printer 10 of this embodiment is a line printing type color inkjet printer having four inkjet heads 12. The printer 10 includes a cassette 20 and a casing 11. The cassette 20 receives therein a roll 500 of a long paper. The cassette 20 is in front of the casing 11. They are fixed to each other with a not-shown fixing member in a state that a protrusion of the cassette 20 corresponding to a front portion of a paper feed port 23 is inserted into a paper feed unit 14 of the casing 11.

The cassette 20 has a detachable case 21. The case 21 is made up of an upper case 21*a* and a lower case 21*b* separable from each other.

Within the lower case 21*b*, a roll supporting mechanism 22 is disposed as one of a shock absorbing mechanism for absorbing a shock to the paper 500*a*. The roll supporting mechanism 22 supports the roll 500 so that the roll 500 can be rotatable, elastically displaceable, and swingable. The roll supporting mechanism 22 includes three supporting rollers 24*a*, 24*b*, and 24*c* rotatably supporting the roll 500, and two springs 25 attached to both ends of the supporting roller 24*c* being at a lower right position in FIG. 1, though FIG. 1 shows only one spring 25.

Each of the supporting rollers 24*a*, 24*b*, and 24*c* is cylindrical and has its axis of rotation parallel to the width of the printer 10 perpendicular to the direction A and perpendicular to FIG. 1. The supporting rollers 24*a*, 24*b*, and 24*c* are arranged at substantially regular intervals within a hollow of the roll 500. Any of the supporting rollers 24*a*, 24*b*, and 24*c* is detachable. Both ends of each of the supporting rollers 24*a*, 24*b*, and 24*c* are inserted in elongated holes formed in not-shown side walls of the lower case 21*b* parallel to FIG. 1. Both ends of each of the supporting rollers 24*a*, 24*b*, and 24*c* are supported in the elongated holes so as to be slideable.

One end of each spring 25 is attached to the corresponding end of the supporting roller 24*c* and the other end of each spring 25 is attached to the lower case 21*b*. The springs 25 supports the supporting roller 24*c* so that the supporting roller can be rotatable, elastically displaceable, and swingable. Particularly in this embodiment, the springs 25 are biasing the supporting roller 24*c* in a direction at an obtuse angle with the direction in which the paper 500*a* is unwound from the roll 500.

A paper feed port 23 is formed in the upper case 21*a* for sending out the paper 500*a* being unwound from the roll 500, to the paper feed unit 14 of the casing 11. Within the upper case 21*a* disposed are a tensioner 26 as one of the shock absorbing mechanism for absorbing a shock to the paper 500*a*, and a guide roller 29 for guiding the paper 500*a* to the paper feed port 23.

The tensioner 26 is disposed between the roll 500 and the paper feed port 23. The tensioner 26 gives the paper 500*a* tension. The tensioner 26 includes a tension roller 27 and two springs 28 attached to both ends of the tension roller 27, though FIG. 1 shows only one spring 28.

The tension roller 27 is cylindrical and has its axis of rotation parallel to the width of the painter 10. The tension roller 27 is disposed so that its outer circumferential surface can come into contact with the back surface of the paper 500*a*. The tension roller 27 is detachable. Both ends of the tension roller 27 are inserted in elongated holes formed in not-shown side walls of the upper case 21*a* parallel to FIG. 1. Both ends of the tension roller 27 are supported in the elongated holes so as to be slideable.

One end of each spring 28 is attached to the corresponding end of the tension roller 27 and the other end of each spring 28 is attached to the upper case 21*a*. The springs 28 supports the tension roller 27 so that the tension roller 27 can be rotatable, elastically displaceable, and swingable.

The guide roller 29 is cylindrical and has its axis of rotation parallel to the width of the printer 10. The guide roller 29 is rotatably supported in the rear of the paper feed port 23.

Next, components disposed within the casing 11 will be described. Within the casing 11, there are disposed, in the order from the rear, a paper feed unit 14, a first contact mechanism 40, heads 12, a conveyor unit 30 disposed to be opposed to the heads 12, a second contact mechanism 60, a curl correcting mechanism 70, a cutting mechanism 50, and a paper discharge unit 18.

Figure 5A:
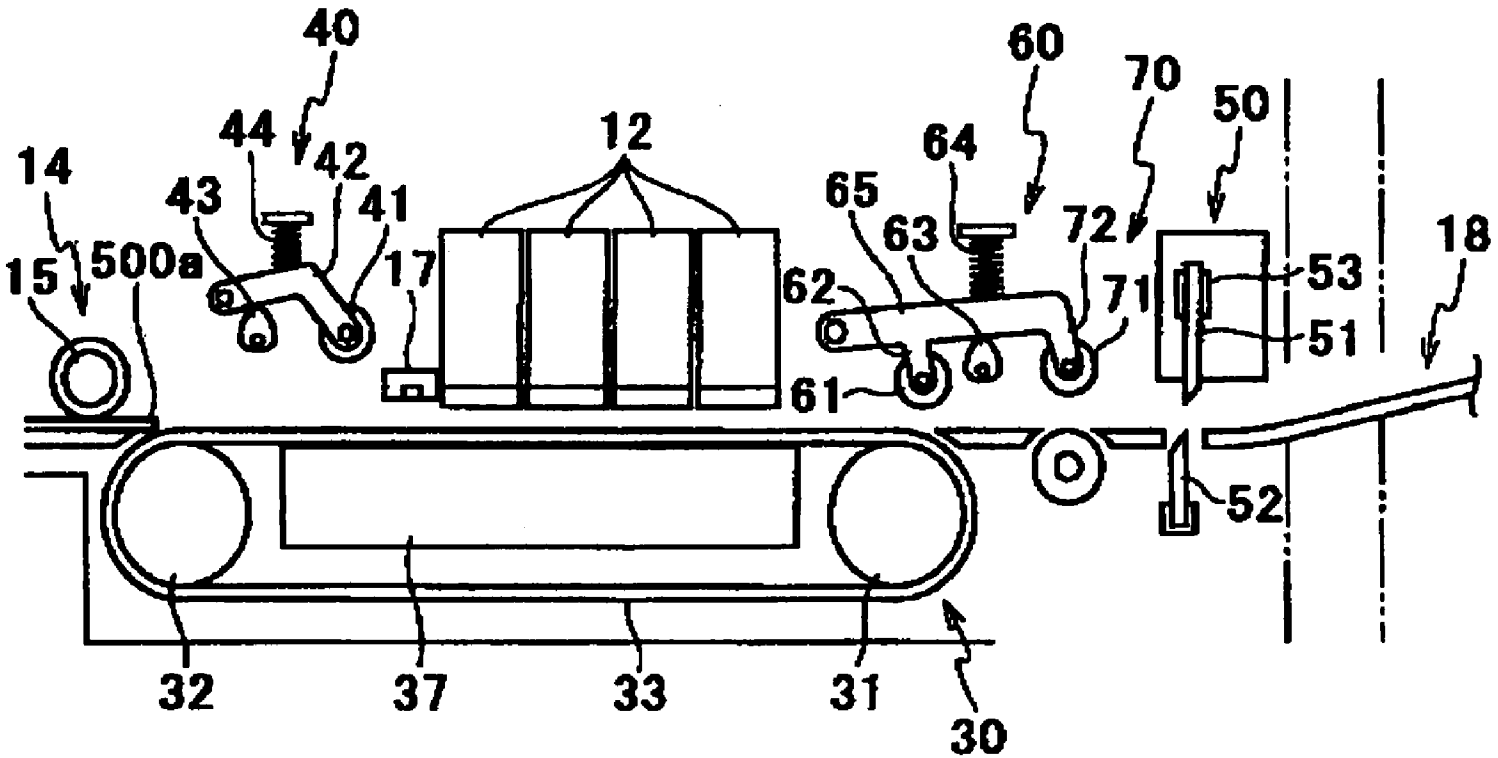
FIGS. 5A to 5D are partial front views showing the operations of the components of the printer of FIG. 1 in the vicinity of the conveyor unit, in the order of steps.
Figure 5B:
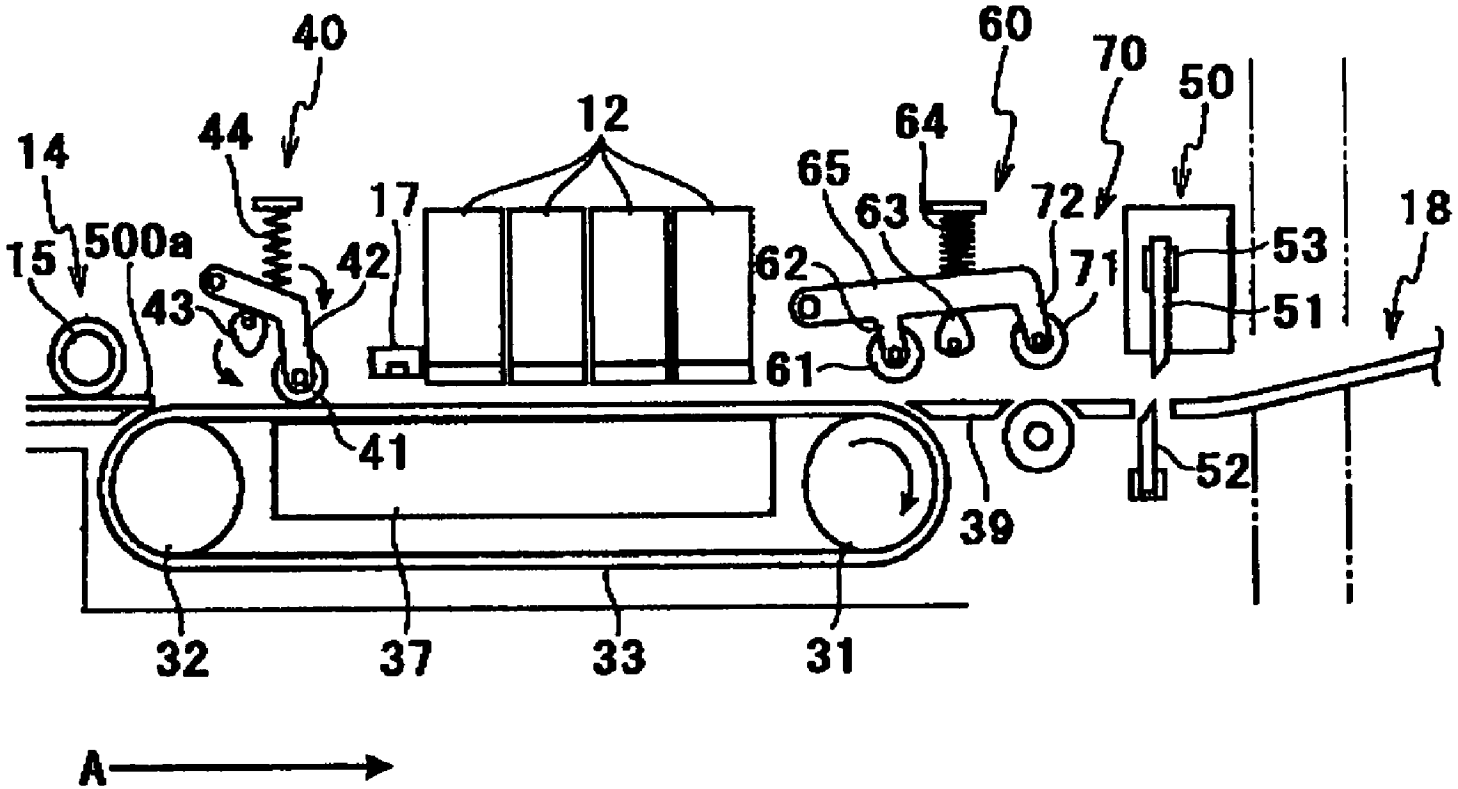
Figure 5C:
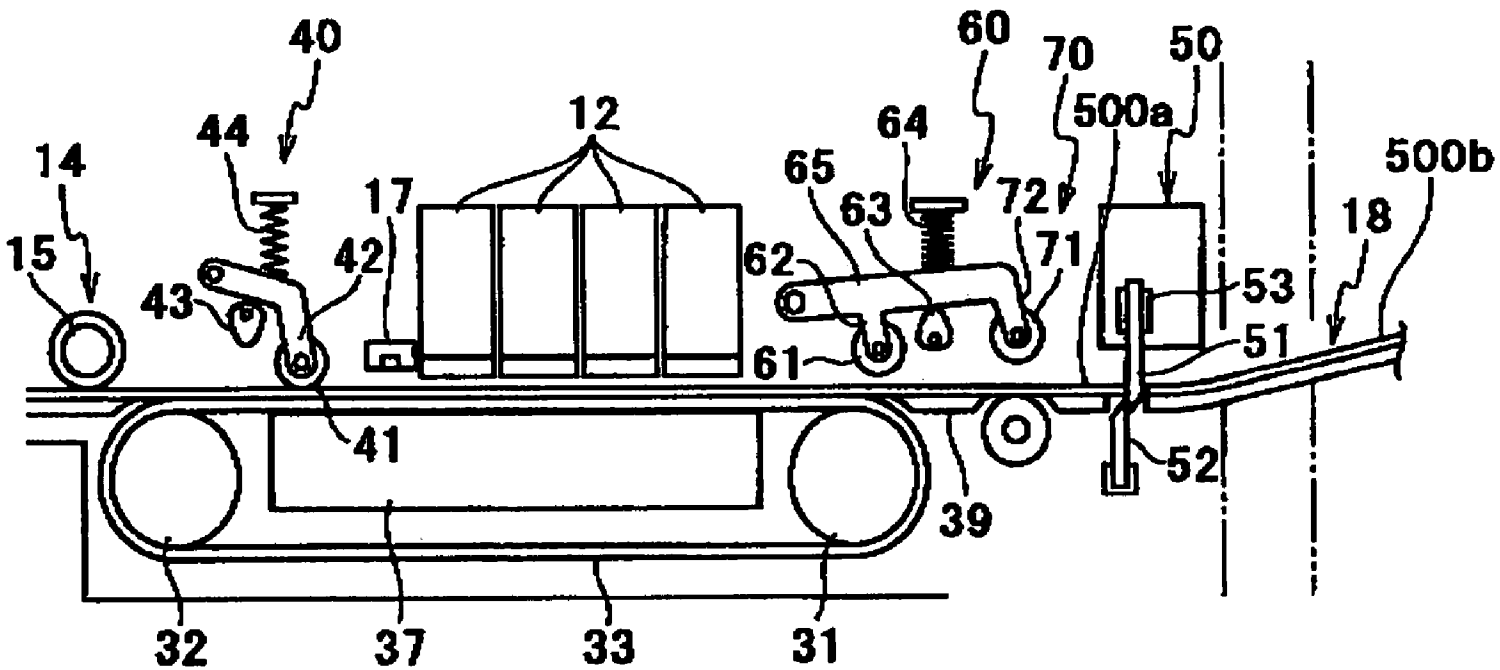

Upon printing, the paper 500*a* being unwound from the roll 500 is conveyed in the direction A for the heads 12. The paper 500*a* is put on a conveyor belt 33 of the conveyor unit 30 and conveyed by the conveyor belt 33. An image is recorded on the paper 500*a* at the position below the heads 12. Thereafter, the paper 500*a* is cut by the cutting mechanism 50. The part of the paper being ahead of the cutting position is thereby cut off into a separate cut sheet 500*b* discontinuous from the roll 500, as shown in FIG. 5C, and thereafter discharged out of the printer 10 through the paper discharge unit 18.

The paper feed unit 14 includes a paper feed roller 15, a paper feed table 16 disposed 80 as to be along the back surface of the paper 500*a*, and a not-shown guide wall substantially perpendicularly standing on the paper feed table 16 and extending in the direction A. The paper feed roller 15 can relatively press the paper 500*a* onto the paper feed table 16 so that the paper 500*a* can be held on the paper feed table 16.

The paper feed roller 15 is cylindrical and disposed so that its outer circumferential surface can come into contact with the back surface of the paper 500*a*. Both ends of the paper feed roller 15 are supported on not-shown side walls of the casing 11 parallel to FIG. 1. One end of the paper feed roller 15 is connected to a paper feed motor 89 shown in FIG. 3. The paper feed motor 89 drives the paper feed roller 15 to rotate. When the paper feed roller 15 is rotated in a state that the paper 500*a* is in contact with the outer circumferential surface of the paper feed roller 15, the paper 500*a* is conveyed with being pressed onto and held on the paper feed table 16.

In plane, the axis of rotation of the paper feed roller 15 is not parallel to the width of the paper 500*a* but oblique at about three degrees. Therefore, the paper 500*a* being conveyed by the rotation of the paper feed roller 15 is brought near to the above-described not-shown guide wall. By thus bringing a aide of the paper 500*a* into contact with the guide wall, the paper 500*a* is made parallel to the direction A. In this manner, oblique movement of the paper 500*a* is corrected before printing.

Not-shown one-way clutches are provided on both ends of the paper feed roller 15. The one-way clutches allow the paper feed roller 15 to be driven by the paper feed motor 89 only when the paper 500*a* is conveyed in the direction A, and to be free to rotate when the paper 500*a* is conveyed in the direction B reverse to the direction A.

The first contact mechanism 40 can bring the paper 500*a* into close contact with the conveyor belt 33. As shown in FIG. 2, the first contact mechanism 40 includes a first pressing roller 41, a first arm pair 42 constituted by two arms 42*a* and 42*b* having the same shape, a nearly triangular first cam 43, and a first spring 44 for biasing the arm pair 42.

The pressing roller 41 is cylindrical and has its axis of rotation parallel to the width of the printer 10. The length of the pressing roller 41 is substantially equal to the width of the conveyor belt 33.

A shaft 46 is disposed between one ends of the arms 42*a* and 42*b* of the arm pair 42. The shaft 46 is fixed to a proper member in the printer 10. The pressing roller 41 is disposed between the other ends of the arms 42*a* and 42*b*. Each of the arms 42*a* and 42*b* is bent at a position between both ends. The shaft 46 is parallel to the width of the printer 10, like the pressing roller 41. The arm pair 42 rotatably supports the pressing roller 41. The arm pair 42 can rotate around the shaft 46.

The cam 43 is disposed under one arm 42*b* of the arm pair 42 between the shaft 46 and the bent position of the arm 42*b*. The cam 43 can rotate around a rotational axis 43a deviated from the center of the cam 43.

The spring 44 is disposed on a side upper face of the one arm 42*b* of the arm pair 42 between the shaft 46 and the bent position of the arm 42*b*. The spring 44 is always biasing the arm pair 42 such that the pressing roller 41 can get near to the conveyor belt 33. More specifically, the spring 44 is biasing the arm pair 42 such that the arm pair 42 can rotate clockwise in FIG. 1 around the shaft 46.

Figure 2:
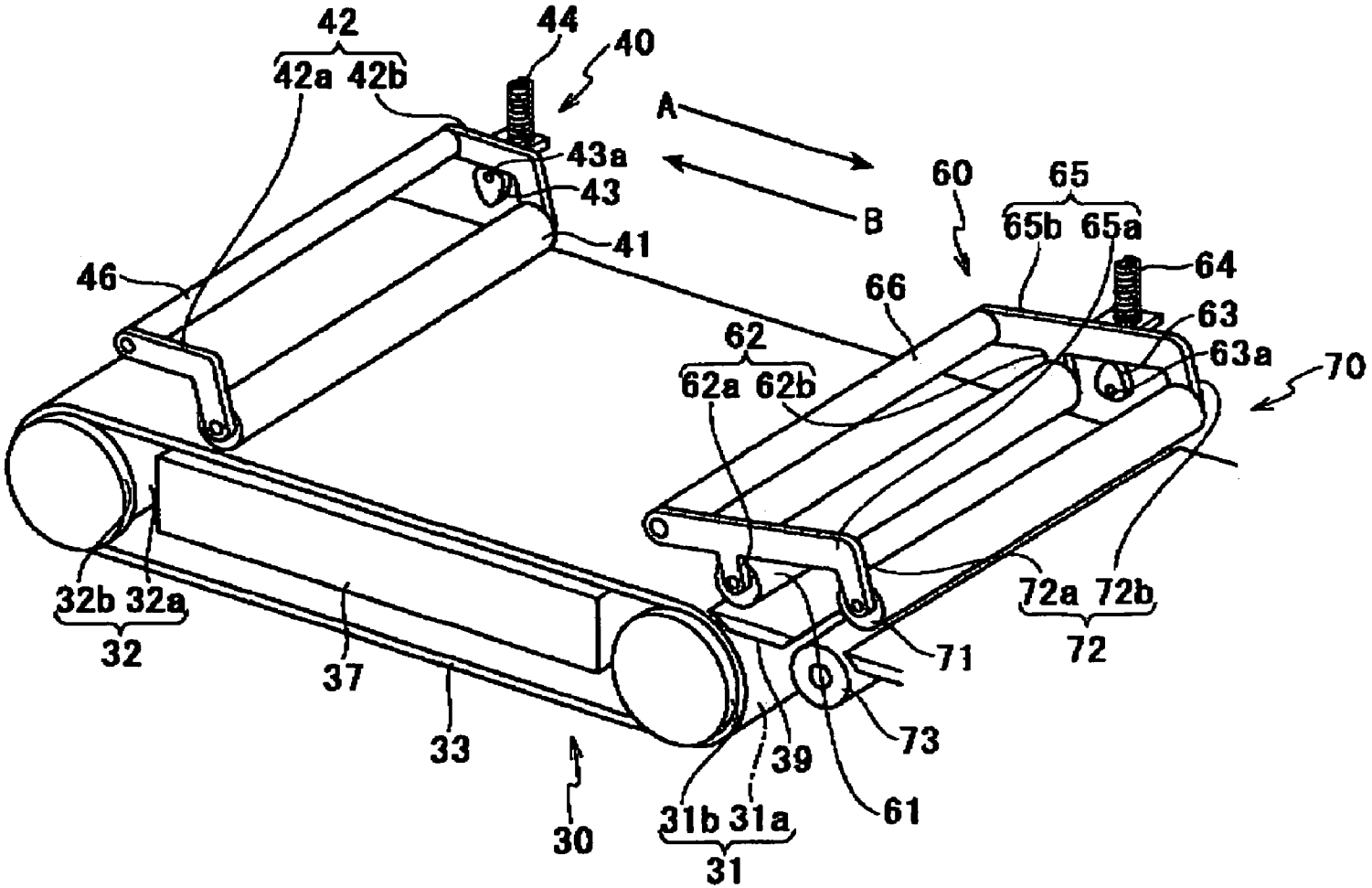
FIG. 2 is a general perspective view of a portion of the printer of FIG. 1 in the vicinity of a conveyor unit.

In the state shown in FIGS. 1 and 2, the cam 43 is separated from the arm 42*b*. In this State, the spring 44 is biasing the arm pair 42 such that the arm pair 42 can rotate clockwise in FIG. 1 around the shaft 46, and the pressing roller 41 is at a position where it can press the paper 500*a* onto the conveyor belt 33.

Figure 3:
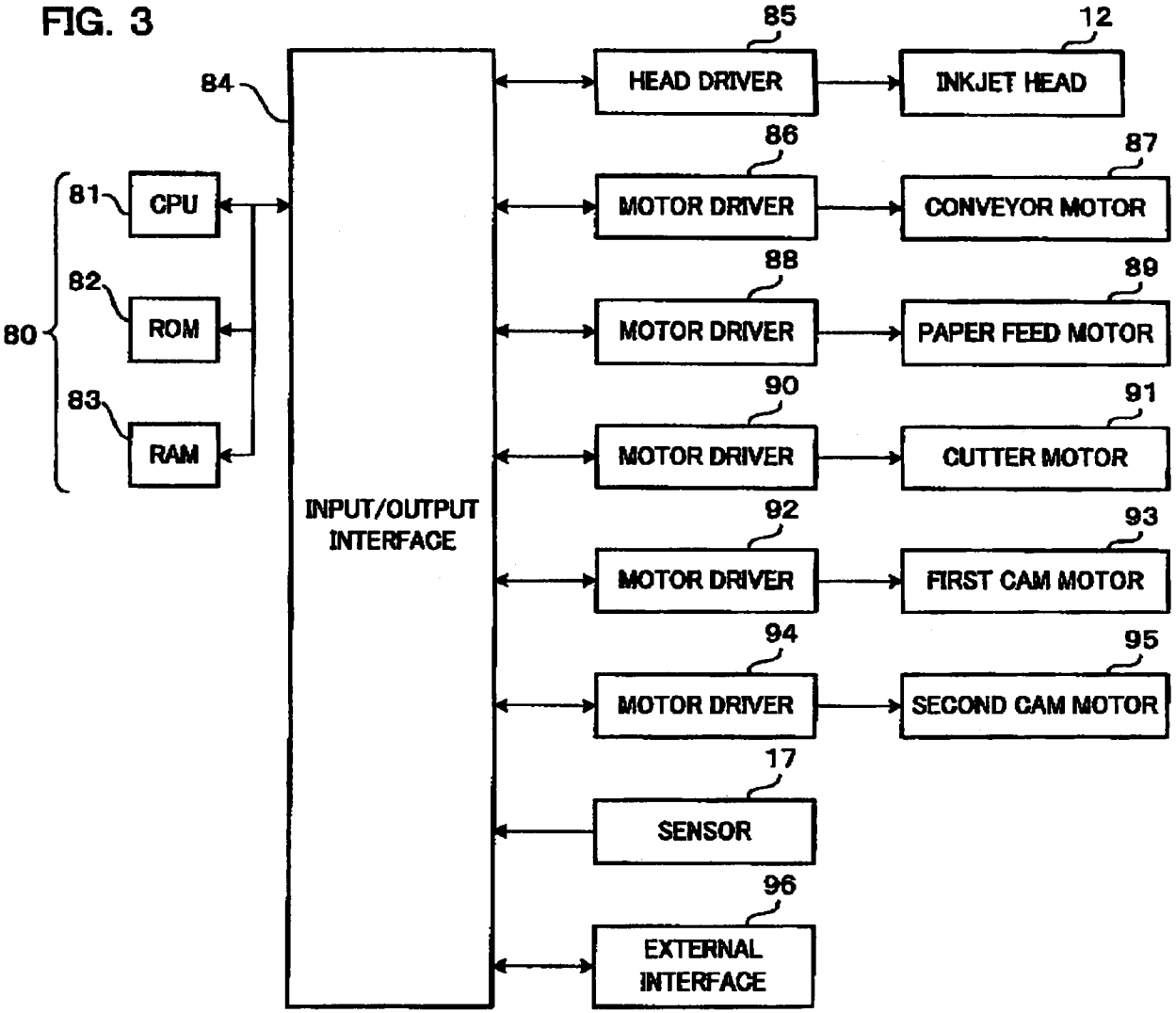
FIG. 3 is a block diagram showing an electrical construction of the printer of FIG. 1.

A first cam motor 93 shown in FIG. 3 connected to the cam 43 is driven to rotate the cam 43 counterclockwise in FIG. 1. Thereby, a tapered end of the cam 43 is brought into contact with the lower face of the arm 42*b*. The cam 43 is further rotated counterclockwise with its tapered end sliding on the lower face of the arm 42*b*. Thereby, two arms 42*a* and 42*b* of the arm pair 42 are rotated counterclockwise together. As a result, the other ends of the arm pair 42, between which the pressing roller 41 is supported, are moved upward so that the pressing roller 41 is distant from the paper 500*a* and the conveyor belt 33, as shown in FIG. 5A.

Afterward, the cam 43 is further rotated counterclockwise in FIG. 1. Thereby, the cam 43 is separated from the arm 42*b*. The arm pair 42 is rotated clockwise by the biasing force of the spring 44, and the other ends of the arm pair 42, between which the pressing roller 41 is supported, are moved downward. Thereby, the pressing roller 41 comes again to the position where it can press the paper 500*a* onto the conveyor belt 33, as shown in FIGS. 1 and 2.

As shown in FIG. 1, a sensor 17 for detecting the paper 500*a* is disposed at a position opposed to the conveyor belt 33 between the first contact mechanism 40 and the heads 12. Detection information of the sensor 17 is used for determining the start timing for image recording by the heads 12, and so on. The sensor 17 is a photo sensor including a light emitting element and a light receiving element. The sensor 17 detects the paper 500*a* on the basis of the difference in intensity of reflection light between the paper 500*a* and the conveyor belt 33.

Four heads 12 are arranged in the direction A close to each other. Each head 12 has at its lower end a head main body 12*a* made up of a flow passage unit and an actuator unit bonded to each other. The flow passage unit includes therein ink flow passages each including a pressure chamber. The actuator unit applies pressure to ink in each pressure chamber. Each head main body 12*a* is rectangular in section. The length of each head main body 12*a* is parallel to the width of the printer 10. The bottom face of each head main body 12*a* is formed into an ink ejection face 12*b* where a large number of nozzles are formed though the nozzles are not shown in FIG. 1. Four head main bodies 12*a* eject inks of magenta (M), yellow (Y), cyan (C), and black (B), respectively.

Each head main body 12*a* is disposed such that its ink ejection face 12*b* is parallel to the paper conveyance face of the conveyor belt 33 and a narrow space is formed between the ink ejection face 12*b* and the paper conveyance face of the conveyor belt 33. The paper conveyance path is formed in the space. While the paper 500*a* put on the conveyor belt 33 passes immediately below four head main bodies 12*a* in order, ink of each color is ejected from nozzles toward the upper face of the paper 500*a*. Thus, a desired color image is recorded on the paper 500*a*.

As shown in FIGS. 1 and 2, the conveyor unit 30 includes two belt rollers 31 and 32, a looped conveyor belt 33 wrapped around the belt rollers 31 and 32 to be stretched between the belt rollers 31 and 32, and a substantially rectangular parallelepiped belt guide 37 disposed within the region surrounded by the conveyor belt 33. The belt guide 37 has substantially the same width as the conveyor belt 33. The upper face of the belt guide 37 is in contact with the inner circumferential surface of the conveyor belt 33 to support the conveyor belt 33.

The material of the conveyor belt 33 is not particularly limited. For example, the conveyor belt 33 may be made of silicone rubber, EPDM, urethane rubber, butyl rubber, or the like. The outer circumferential surface of the conveyor belt 33 has been treated with adhesive silicone rubber, on which surface the paper 500*a* is put.

As shown in FIG. 2, the belt rollers 31 and 32 have cylinders 31*a* and 32*a* to be in contact with the inner circumferential surface of the conveyor belt 33, and flanges 31*b* and 32*b* provided at both ends of the cylinders 31*a* and 32*a*, respectively. The belt rollers 31 and 32 are rotatably supported through not-shown shafts attached to the centers of the respective flange portions 31*b* and 32*b*. The flange portions 31*b* and 32*b* have their radius substantially equal to the sum of the thickness of the conveyor belt 33 and the radius of the cylinders 31*a* and 32*a*.

One belt roller 31 disposed on the front side is a drive roller connected to a conveyor motor 87 shown in FIG. 3. When the belt roller 31 is rotated by drive of the conveyor motor 87, the conveyor belt 33 is driven to rotate. Attendant upon the rotation of the conveyor belt 33, the other belt roller 32 as a follower is rotated.

As shown in FIGS. 1 and 2, a peeling plate 39 is disposed ahead of the conveyor belt 33. The peeling plate 39 peels the paper 500*a*, which is in close contact with the conveyor belt 33, off the conveyor belt 33.

The second contact mechanism 60 can bring the paper 500*a* into close contact with the conveyor belt 33, like the first contact mechanism 40. As shown in FIG. 2, the second contact mechanism 60 includes a second pressing roller 61, a protrusion pair 62 constituted by two protrusions 62*a* and 62*b* formed on two arms 65*a* and 65*b* constituting a second arm pair 65, a nearly triangular second cam 63, and a second spring 64 for biasing the arm pair 65.

The pressing roller 61 is cylindrical and has its axis of rotation parallel to the width of the printer 10. The length of the pressing roller 61 is substantially equal to the width of the conveyor belt 33.

Two arms 65*a* and 65*b* constituting the arm pair 65 are made of slender members having the same shape. A shaft 66 is disposed between one ends of the arms 65*a* and 65*b*. The shaft 66 is fixed to a proper member in the printer 10. The shaft 66 is parallel to the width of the printer 10, like the pressing roller 61.

The arms 65*a* and 65*b* have the protrusions 62*a* and 62*b* between both ends of the arms 65*a* and 65*b*, respectively. The protrusions 62*a* and 62*b* protrude somewhat obliquely relatively to the width of the arms 65*a* and 65*b*. The arms 65*a* and 65*b* have bent portions 72*a* and 72*b* near the front ends of arms 65*a* and 65*b*, respectively. The arms 65*a* and 65*b* are bent at the bent portions 72*a* and 72*b* to the direction substantially parallel to the protrusions 62*a* and 62*b*. The pressing roller 61 is rotatably supported between the protrusions 62*a* and 62*b*. A movable roller 71 of the curl correcting mechanism 70 is rotatably supported between the bent portions 72*a* and 72*b*. When the arm pair 65 is rotated around the shaft 66, the pressing roller 61 supported by the protrusion pair 62 and the movable roller 71 supported by the bent portion pair 72 are moved accordingly.

The cam 63 has substantially the same construction as the above-described first cam 43. The cam 63 is disposed under one arm 65*b* of the arm pair 65 between the protrusion 62*b* and the bent position 72*b*. The cam 63 can rotate around a rotational axis 63*a* deviated from the center of the cam 63.

The spring 64 is disposed on a side upper face of the one arm 65*b* of the arm pair 65 between the protrusion 62*b* and the bent position 72*b*. The spring 64 is always biasing the arm pair 65 such that the arm pair 65 can rotate clockwise in FIG. 1 around the shaft 66. That is, the spring 64 is biasing the arm pair 65 such that the pressing roller 61 can get near to the conveyor belt 33 and the movable roller 71 can get near to a fixed roller 73.

The curl correcting mechanism 70 corrects the tendency to curl, in the vicinity of the leading edge of the paper 500*a*. As shown in FIG. 2, the curl correcting mechanism 70 includes a movable roller 71, a fixed roller 73, and a bent portion pair 72 constituted by the above-described bent portions 72*a* and 72*b* of the respective arms 65*a* and 65*b*.

Either of the movable and fixed rollers 71 and 73 is cylindrical and has its axis of rotation parallel to the width of the printer 10. The length of each of the movable and fixed rollers 71 and 73 is substantially equal to the width of the conveyor belt 33. The movable roller 71 is made of a plastic material such as stainless steel. The fixed roller 73 is made of an elastic material such as sponge. The movable roller 71 is disposed so as to be opposed to the upper surface of the paper 500*a* while the fixed roller 73 is disposed such that its outer circumferential surface can be in contact with the back surface of the paper 500*a*.

In the state shown in FIGS. 1 and 2, the cam 63 is held in a state that a tapered end of the cam 63 faces upward and is in contact with the lower face of the arm 65*b*. In this state, the arm pair 65 is held at a position where the pressing roller 61 is distant from the paper 500*a* and the conveyor belt 33 and the movable roller 71 is distant from the fixed roller 73.

Figure 5D:
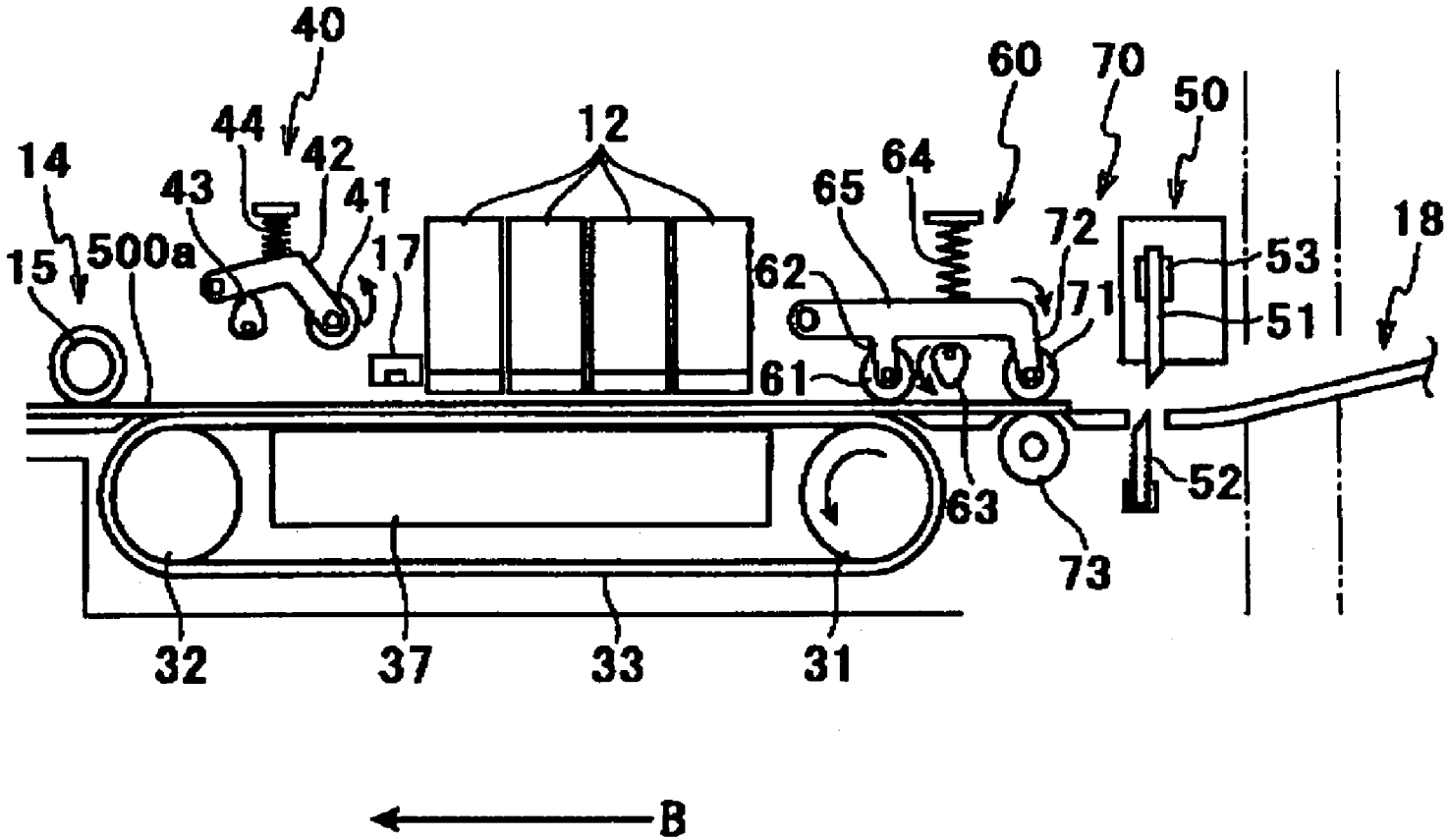

A second cam motor 95 shown in FIG. 3 connected to the cam 63 is driven to rotate the cam 63 counterclockwise in FIG. 1. Thereby, the cam 63 is separated from the arm 65*b*. The arm pair 65 is rotated clockwise by the biasing force of the spring 64. The protrusion pair 62, between which the pressing roller 61 is supported, and the bent portion pair 72, between which the movable roller 71 is supported, are moved downward together. Thereby, the pressing roller 61 comes to a position where the pressing roller 61 can press the paper 500*a* onto the conveyor belt 33, and the movable roller 71 comes to a position where the movable roller 71 can cooperate with the fixed roller 73 to pinch the paper 500*a*, as shown in FIG. 5D.

Afterward, the cam 63 is further rotated counterclockwise in FIG. 1. Thereby, the tapered end of the cam 63 is brought into contact with the lower face of the arm 65*b*. The cam 63 is further rotated counterclockwise with its tapered end sliding on the lower face of the arm 65*b*. Thereby, two arms 65*a* and 65*b* of the arm pair 65 are rotated counterclockwise together. As a result, the pressing roller 61 is again distant from the paper 500*a* and the conveyor belt 33 and the movable roller 71 is also again distant from the fixed roller 73, as shown in FIGS. 1 and 2.

As shown in FIG. 1, the cutting mechanism 50 includes a movable edge 51, a fixed edge 52, and an actuator 53 vertically movable with supporting the movable edge 51.

The movable edge 51 has its width larger than the paper 500*a*. The movable edge 51 has an edge face inclined relatively to a horizontal plane. The movable edge 51 is fixed to the actuator 53 at a position above the conveyance path of the paper 500*a* such that the edge face of the movable edge 51 faces downward. The fixed edge 52 has substantially the same width as the movable edge 51. The fixed edge 52 is fixed at a position below the conveyance path of the paper 500*a* such that an edge face of the fixed edge 52 faces upward.

The actuator 53 is moved downward and upward by the drive of a cutter motor 91 shown in FIG. 3 so that the paper 500*a* is cut at a position where the movable edge 51 overlaps the fixed edge 52. The timings for cutting are controlled by a controller 80 as will be described later.

Next, an electrical construction of the printer 10 including the controller 80 will be described with reference to FIG. 3.

The controller 60 includes a CPU (Central Processing Unit) 81, a ROM 82 storing therein programs and data for the CPU 81 to perform controlling operations, and a RAM 83 as a temporarily storing memory.

The CPU 81, the ROM 82, and the RAM 83 included in the controller 80 are connected to an input/output interface 84 through data buses. The input/output interface 84 is connected to a head driver 85 for driving the heads 12; a motor driver 86 for driving the conveyor motor 87; a motor driver 88 for driving the paper feed motor 89; a motor driver 90 for driving the cutter motor 91; a motor driver 92 for driving the first cam motor 93; a motor driver 94 for driving the second cam motor 95; a sensor 17; and an external interface for communicating with the outside to exchange various data such as image data. The divers, the sensor, etc., can exchange signals with the controller 80 through the input/output interface 84.

The CPU 81 prepares printing data on the basis of a printing instruction signal received via the external interface 96. On the basis of the printing data, the CPU 81 controls the above drivers to operate.

The controller 80 functions as an image recording controller for controlling the heads 12 to record an image on the paper 500*a* being conveyed in the direction A; a contact operation controller for controlling the operations of the first and second contact mechanisms 40 and 60; a conveyor controller for controlling the conveyor unit 30 to switch over the conveyance direction of the paper 500*a* put on the conveyor belt 33 between the directions A and B; a cutter controller for controlling the movable edge 51 to cut the paper 500*a* being conveyed in the direction A, at a desired position; and so on.

Next, operations of components in the vicinity of the conveyor unit 30 in the printer 10 will be described with reference to FIGS. 4, and 5A to 5D. The operations of the components as will be described below are controlled by the controller 80 shown in FIG. 3.

Before printing, as shown in FIG. 5A, the cams 43 and 63 of the first and second contact mechanisms 40 and 60 are held in a state that both the tapered ends of the cams 43 and 63 face upward and are in contact with the lower faces of the arms 42*b* and 65*b* shown in FIG. 2. At this time, the first arm pair 42 is held at a position where the first pressing roller 41 is distant from the paper 500*a* and the conveyor belt 33. The second arm pair 65 is held at a position where the second pressing roller 61 is distant from the paper 500*a* and the conveyor belt 33 and the movable roller 71 is distant from the fixed roller 73. The leading edge of the paper 500*a* is at a position near the paper feed roller 15 of the paper feed unit 14, and has not yet reached the paper conveyance path on the conveyor belt 33.

For printing, first, the first pressing roller 41 of the first contact mechanism 40 is moved downward, in Step S101. More specifically, the first cam motor 93 shown in FIG. 3 is driven so that the first cam 43 is rotated counterclockwise from the state shown in FIG. 5A and thereby separated from the arm 42*b* shown in FIG. 2. Thereby, as shown in FIG. 5B, the arm pair 42 is rotated clockwise by the biasing force of the spring 44 so that the other ends of the arm pair 42, between which the pressing roller 41 is supported, are moved downward. The pressing roller 41 then comes to the position where it can press the paper 500*a* onto the conveyor belt 33.

Next, the conveyor motor 87 shown in FIG. 3 is driven to start normal rotation of the conveyor belt 33, in Step S102. The term "normal rotation" means that the belt roller 31 as the drive roller is rotated clockwise as shown in FIG. 5B and the upper part of the conveyor belt 33 runs in the direction A.

Afterward, the paper feed motor 89 shown in FIG. 3 is driven to start rotation of the paper feed roller 15, in Step S103. By the rotation of the paper feed roller 15, the paper 500*a* is conveyed in the direction A and its leading edge reaches the paper conveyance path on the conveyor belt 33. When the paper 500*a* reaches the position where the first contact mechanism 40 can bring the paper 500*a* into close contact with the conveyor belt 33, that is, the position where the first pressing roller 41 is disposed, the first pressing roller 41, which has been brought to the position where it can press the paper 500*a* onto the conveyor belt 33, presses the paper 500*a* onto the conveyor belt 33. Thus, the paper 500*a* is conveyed with being in close contact with the conveyor belt 33.

After the rotation of the paper feed roller 15 is started, a paper detecting operation of the sensor 17 is started. The detection information of the sensor 17 is sent to the CPU 81 shown in FIG. 3. The CPU 81 judges in Step S104 whether or not the sensor 17 has detected the paper 500*a*. If the paper 500*a* has not yet been detected, that is, NO in Step S104, the CPU 81 judges whether or not a predetermined time period has elapsed, in Step S105.

If the predetermined time period has elapsed, that is, YES in Step S105, the CPU 81 judges the condition to be "error". In this case, the first pressing roller 41 of the first contact mechanism 40 is moved upward, in Step S106, so that the pressing roller 41 is again distant from the paper 500*a* and the conveyance belt 33 as shown in FIG. 5A, and then the operations of the components of are ended. This case may occur, for example, when the paper 500*a* is not adequately conveyed.

In the case that the paper 500*a* is adequately conveyed in the direction A with being in close contact with the conveyor belt 33 after the rotation of the paper feed roller 15 is started, the sensor 17 detects the paper 500*a* within the predetermined time period. When the paper 500*a* is detected, that is, YES in Step S104, the rotation of the paper feed roller 15 is stopped, in Step S107. The CPU 81 controls the drive of the heads 12 on the basis of the printing data prepared as described above, to record an image on the paper 500*a* being conveyed, in Step S108.

After completion of image recording by the heads 12, the CPU 81 shown in FIG. 3 judges in Step S109 whether or not the portion of the paper 500*a* distant by a predetermined distance from the rearmost end of the region where the image has been recorded, has been opposed to the movable and fixed edges 51 and 52 of the cutting mechanism 50. More specifically, this judgment is made on the basis of the movement distance of the paper 500*a* calculated from the number of revolutions of the conveyor motor 87 shown in FIG. 3 after the completion of image recording.

When the leading edge of the paper 500*a* reaches the position where the peeling plate 39 is disposed, the paper 500*a*, which is in close contact with the conveyor belt 33, is peeled off the conveyor belt 33 by the peeling plate 39, and then conveyed to the cutting mechanism 50.

When the portion of the paper 500*a* to cut reaches the cutting position by the cutting mechanism 50, that is, YES in Step S109, the conveyor belt 33 is stopped, in Step S110. In this state, as shown in FIG. 5C, the paper 500*a* is cut, in Step S111.

After the cutting operation in Step S111, the part of the paper 500*a* in the rear of the cutting position by the cutting mechanism 50 and continuous to the roll 500 is rewound onto the roll 500. That is, the paper 500*a* is conveyed in the direction B reverse to the direction A, as shown in FIG. 5D. Immediately after the cutting operation, the leading edge of the paper 500*a* is at the position where the movable and fixed edges 51 and 52 of the cutting mechanism 50 are disposed, distant ahead of the conveyor belt 33. The portion of the paper 500*a* near the leading edge has been peeled off the conveyor belt 33 by the peeling plate 39.

Before the rewinding operation, first, the second pressing roller 61 of the second contact mechanism 60 and the movable roller 71 of the curl correcting mechanism 70 are moved downward, in Step S112. More specifically, the second cam motor 95 shown in FIG. 3 is driven so that the second cam 63 is rotated counterclockwise from the state shown in FIG. 5C and thereby separated from the arm 65*b* shown in FIG. 2. Thereby, as shown in FIG. 5D, the arm pair 65 is rotated clockwise by the biasing force of the spring 64 so that the protrusion pair 62, between which the pressing roller 61 is supported, and the bent portion pair 72, between which the movable roller 71 is supported, are moved downward together. The second pressing roller 61 then comes to the position where it can press the paper 500*a* onto the conveyor belt 33, and the movable roller 71 comes to the position where it can cooperate with the fixed roller 73 to pinch the paper 500*a*.

Next, the first pressing roller 41 of the first contact mechanism 40 is moved upward, in Step S113, so that the pressing roller 41 is again distant from the paper 500*a* and the conveyor belt 33. Reverse rotation of the conveyor belt 33 is then started, in Step S114. The term "reverse rotation" means that the belt roller 31 as the drive roller is rotated counterclockwise as shown in FIG. 5D and the upper part of the conveyor belt 33 runs in the direction B.

After the reverse rotation of the conveyor belt 33 is started, the paper 500*a* is conveyed in the direction B. The portion of the paper 500*a* near the leading edge, which has been peeled off the conveyor belt 33, is pinched by the movable and fixed rollers 71 and 73 of the curl correcting mechanism 70 and thereby the tendency to curl is corrected. The portion of the paper 500*a* near the leading edge is then pressed onto the conveyor belt 33 by the second pressing roller 61 of the second contact mechanism 60. Thus, the paper 500*a* is conveyed on the conveyor belt 33 with being in close contact with the conveyor belt 33.

After the reverse rotation of the conveyor belt 33 is started, a paper detecting operation of the sensor 17 is started. The detection information of the sensor 17 is sent to the CPU 81 shown in FIG. 3. The CPU 81 judges in Step S115 whether or not the paper 500*a* has been undetectable by the sensor 17.

When the paper 500*a* has been undetectable by the sensor 17, that is, YES in Step S115, the paper 500*a* is conveyed in the direction B till the leading edge of the paper 500*a* reaches a position in the rear of the pressing position by the first pressing roller 41 of the first contact mechanism 40, and then the conveyor belt 33 is stopped, in Step S116. Because the conveyance of the paper 500*a* is stopped in a state that the leading edge of the paper 500*a* is in the rear of the pressing position by the first pressing roller 41 as described above, the first pressing roller 41 can bring the paper 500*a* into close contact with the conveyor belt 33 from the leading edge of the paper 500*a* in the next printing operation.

After the conveyor belt 33 is stopped, the second pressing roller 61 of the second contact mechanism 60 and the movable roller 71 of the curl correcting mechanism 70 are moved upward, in Step 5117. Thereby, the pressing roller 61 is distant from the paper 500*a* and the conveyor belt 33, and the movable roller 71 is distant from the fixed roller 73. Thus, the printer 10 is again in the state shown in FIG. 5A.

Figure 6C:
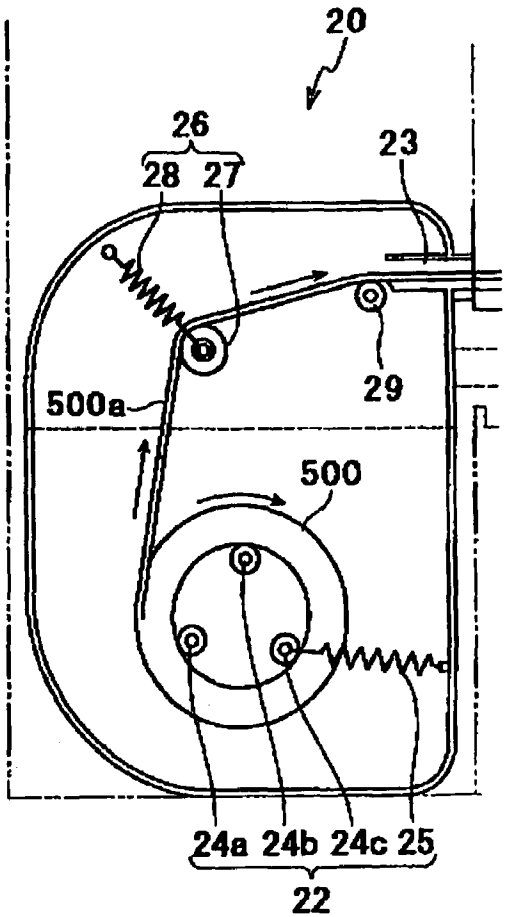
FIGS. 6A to 6C are partial front views showing operations of a roll supporting mechanism and a tensioner, in the order of steps, when a roll starts rotating.
Figure 6B:
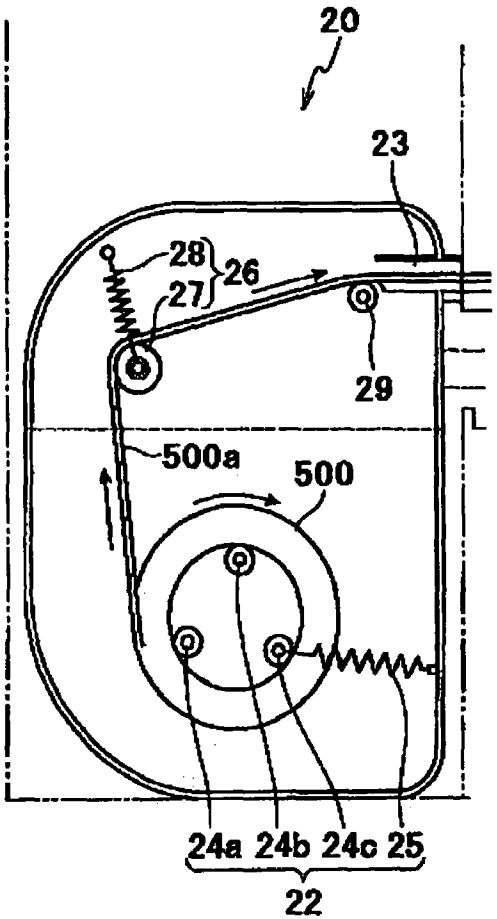

Next, operations of the roll supporting mechanism 22 and the tensioner 26 disposed within the cassette 20 when the roll 500 starts rotating will be described with reference to FIGS. 6A to 6C.

Figure 4:
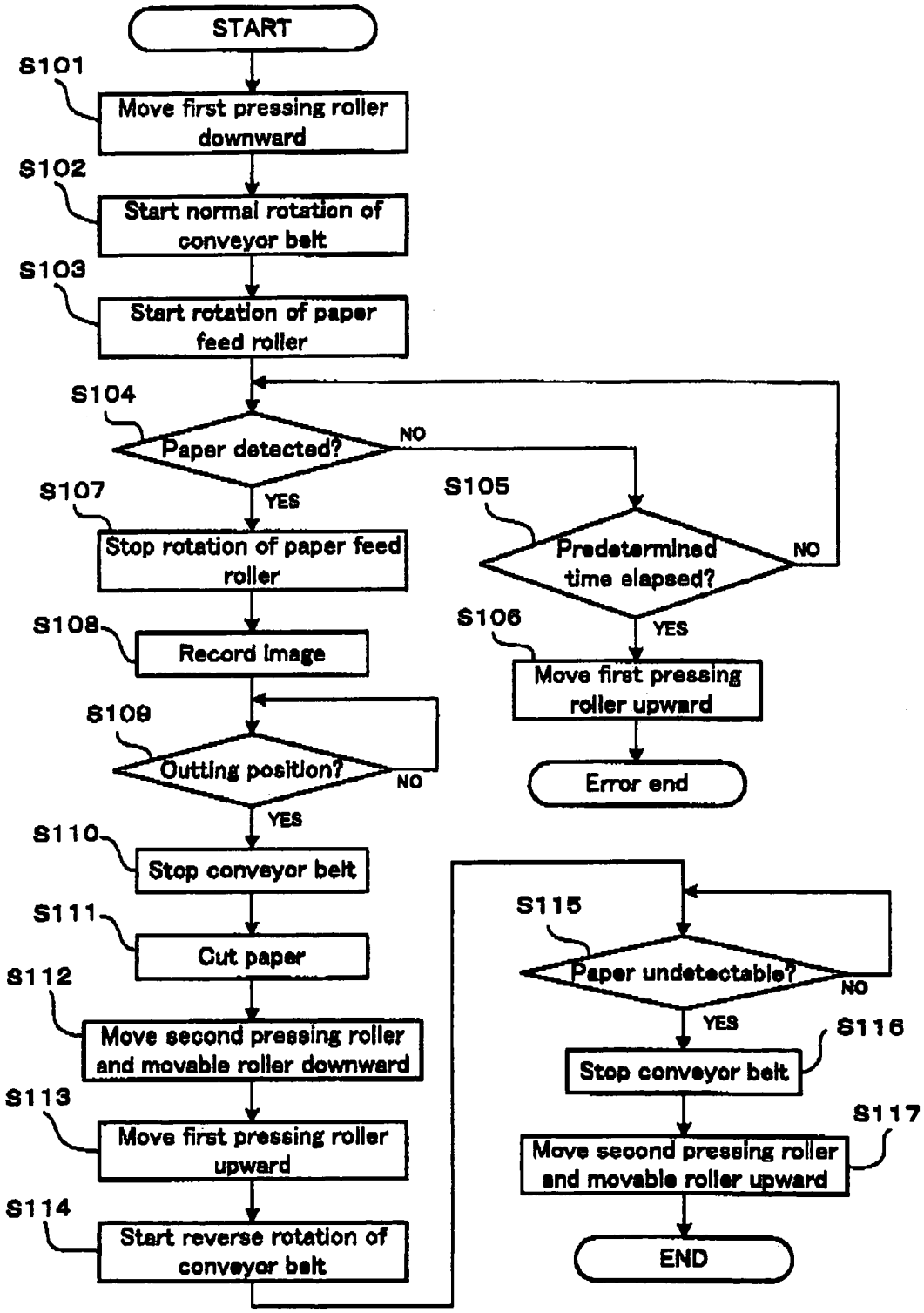
FIG. 4 is a flowchart showing operations of components of the printer of FIG. 1 in the vicinity of the conveyor unit.
Figure 6A:
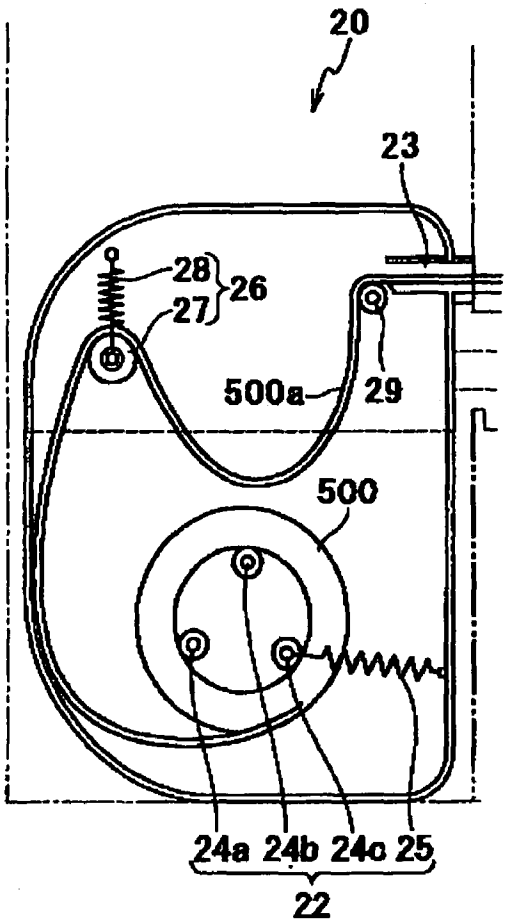

FIG. 6A shows a state before the paper 500*a* is conveyed by the above-described Step S103 shown in FIG. 4. The paper 500*a* was rewound to the roll 500 after the last printing operation. At that time, looseness is generated in the portion of the paper 500*a* within the cassette 20. As Steps S101 and S102 are performed, the paper feed roller 15 is rotated in Step S103, and thereby the paper 500*a* is being conveyed, the looseness of the paper 500*a* generated within the cassette 20 is gradually eliminated.

Simultaneously with elimination of the looseness, the roll 500 starts to be rotated. At this time, because of a sharp change in tension on the paper 500*a*, a shock may be applied to the paper 500*a*. However, the shock is absorbed by the roll supporting mechanism 22 and the tensioner 26. More specifically, as shown in FIGS. 6B and 6C, because the roll 500 is supported by the roll supporting mechanism 22 with suppressing ricketiness and the paper 500*a* being unwound from the roll 500 is conveyed with being given a proper tension by the tensioner 26, the shock is absorbed.

As described above, in the inkjet printer 10 of this embodiment, when image recording is performed on the paper 500*a* being conveyed in the direction A, because the first contact mechanism 40 brings the paper 500*a* into close contact with the conveyor belt 33, good image recording can be achieved. On the other hand, when the paper 500*a* is conveyed in the direction B reverse to the direction A after image recording and being cut, the second contact mechanism 60 can bring the portion of the paper 500*a* near its leading edge, which is apt to curve upward due to its tendency to curl, into close contact with the conveyor belt 33. Thus, the paper 500*a* is prevented from coming into contact with any head 12.

In addition, the first contact mechanism 40 has a relatively simple construction that includes the first pressing roller 41 that can be selectively at a position where it can press the paper 500*a* onto the conveyor belt 33 and at a position where it is distant from the paper 500*a* and the conveyor belt 33.

The first contact mechanism 40 including the first pressing roller 41, the first arm 42, the first cam 43, and the first spring 44, can efficiently bring the paper 500*a* into close contact with the conveyor belt 33 though the first contact mechanism 40 has a relatively simple construction.

Before the leading edge of the paper 500*a* reaches the position where the pressing roller 41 of the first contact mechanism 40 can press the paper 500*a* onto the conveyor belt 33, the pressing roller 41 comes to the position where it can press the paper 500*a* onto the conveyor belt 33, in Step S101. Thus, the paper 500*a* being conveyed in the direction A can be brought into close contact with the conveyor belt 33 in order from the leading edge of the paper 500*a*. In case that the pressing roller 41 is moved downward after the leading edge of the paper 500*a* reaches the above position, a problem may arise that the portion of the paper 500*a* near the leading edge can not adequately be brought into close contact with the conveyor belt 33. In this embodiment, however, the problem can be relieved.

Further, before the paper 500*a* cut in Step S111 shown in FIG. 4 is conveyed in the direction B in Step S114, the first pressing roller 41 is moved upward to be distant from the paper 500*a* and the conveyor belt 33. While the paper 500*a* is conveyed in the direction B, the first pressing roller 41 is kept distant from the paper 500*a* and the conveyor belt 33. For example, in case that the paper 500*a* is conveyed in the direction B in Step S114 in a state that the first pressing roller 41 is at the position where it can press the paper 500*a* onto the conveyor belt 33, a bent portion may be formed in the paper 500*a* ahead of the first pressing roller 41 in the direction A due to the friction between the paper 500*a* and the first pressing roller 41. The bent portion of the paper 500*a* may come into contact with a head 12. However, this embodiment can prevent this.

The second contact mechanism 60 also has a relatively simple construction that includes the second pressing roller 61 that can be selectively at a position where it can press the paper 500*a* onto the conveyor belt 33 and at a position where it is distant from the paper 500*a* and the conveyor belt 33.

The second contact mechanism 60 including the second pressing roller 61, the protrusion pair 62, the second cam 63, and the second spring 64, can efficiently bring the paper 500*a* into close contact with the conveyor belt 33 though the second contact mechanism 60 has a relatively simple construction.

Before the paper 500*a* starts to be conveyed in the direction B after the conveyance of the paper 500*a* in the direction A is completed, the pressing roller 61 of the second contact mechanism 60 comes to the position where it can press the paper 500*a* onto the conveyor belt 33, in Step S112. Thus, the paper 500*a* can be brought into close contact with the conveyor belt 33 in order from the portion of the paper 500*a* corresponding to the pressing roller 61. As a result, the portion of the paper 500*a* near the leading edge can be more surely prevented from coming into contact with a head 12 in comparison with a case wherein the pressing roller 61 is moved downward after the paper 500*a* starts to be conveyed in the direction B.

Further, after the conveyance of the paper 500*a* in the direction B in Step S114 is completed, the second pressing roller 61 is moved upward in Step S117 to be distant from the paper 500*a* and the conveyor belt 33. While the paper 500*a* is conveyed in the direction A, the second pressing roller 61 is kept distant from the paper 500*a* and the conveyor belt 33. For example, in case that the paper 500*a* is conveyed in the direction A in Step S102 in a state that the second pressing roller 61 is at the position where it can press the paper 500*a* onto the conveyor belt 33, a bent portion may be formed in the paper 500*a* in the rear of the second pressing roller 61 in the direction A due to the friction between the paper 500*a* and the second pressing roller 61. The bent portion of the paper 500*a* may come into contact with a head 12. However, this embodiment can prevent this.

Further, the printer 10 includes the curl correcting mechanism 70 ahead of the second contact mechanism 60 in the direction A. After the paper 500*a* starts to be conveyed in the direction B in Step S114, the curl correcting mechanism 70 corrects the tendency to curl of the portion of the paper 500*a* near the leading edge before the portion of the paper 500*a* reaches the second contact mechanism 60. This improves the contactability of the paper 500*a* onto the conveyor belt 33, and more surely relieves the above problem that the paper 500*a* may come into contact with a head 12.

In the curl correcting mechanism 70, the action of the bent portion pair 72, between which the movable roller 71 is rotatably supported, is linked to the action of the second arm, i.e., the protrusion pair 61, of the second contact mechanism 60 through the arm pair 65. Therefore, there is no need of special means for controlling the action of the curl correcting mechanism 70. In addition, because the second pressing roller 61 and the movable roller 71 are moved downward together so that they simultaneously comes to the position where the second pressing roller 61 can press the paper 500*a* onto the conveyor belt 33 and the position where the movable roller 71 can cooperate with the fixed roller 71 to pinch the paper 500*a*, respectively, as described above and shown in FIGS. 4 and 5D, the number of steps can be decreased.

In addition, because the above bent portion pair 72 of the curl correcting mechanism 70 is formed integrally with the protrusion pair 62 of the second contact mechanism 60, the number of parts can be decreased.

Because the movable roller 71 is made of a plastic material and the fixed roller 73 is made of an elastic material in the curl correcting mechanism 70, the effect of correcting the tendency to curl of the paper 500*a* is further improved.

Further, the printer 10 includes the roll supporting mechanism 22 and the tensioner 26 as a shock absorbing mechanism for absorbing a shock to the paper 500*a*. Thus, the paper 500*a* is prevented from receiving a strong shock, for example, because of a sharp change in tension on the paper 500*a* when the roll 500 starts to be rotated.

If such a shock absorbing mechanism is provided in the printer 10, there is probability that the paper feed motor 89 shown in FIG. 3 for driving the paper feed roller 15 is locked due to the shock. In addition, because the conveyance of the paper 500*a* is stopped in a moment, slur may occur and the paper 500*a* being in close contact with the conveyor belt 33 may be peeled off the conveyor belt 33. In this embodiment, however, because the shock absorbing mechanism including the roll supporting mechanism 22 and the tensioner 26 is provided, the above problem can be relieved.

In the above-described embodiment, the roll supporting mechanism 22 has a construction in which the spring 25 is attached to one supporting roller 24*c* of three supporting rollers 24*a* to 24*c*. The present invention is not limited to this construction. A spring may be attached also to one or either of the other two supporting roller 24*a* and 24*b*. In addition, the roll supporting mechanism suffice if it can support the roll 500 so that the roll 500 can be rotatable and elastically displaceable or rotatable and swingable. Thus, the construction of the roll supporting mechanism is not limited to that including the supporting rollers 24*a* to 24*c* and the spring 25.

The shock absorbing mechanism of the printer 10 may not be made up of both of the roll supporting mechanism 22 and the tensioner 26. The shock absorbing mechanism may be one of the roll supporting mechanism 22 and the tensioner 26. The shock absorbing mechanism may have another construction that brings about an effect of absorbing a shock. Further, the printer 10 may include no shock absorbing mechanism.

The curl correcting mechanism 70 may have another construction that brings about a similar effect. For example, the bent portion pair 72 of the curl correcting mechanism 70 may not be formed integrally with the protrusion pair 62 of the second contact mechanism 60 as in the above-described embodiment. In this case, a gear may be provided at an end portion of the shaft 65*a* of the second arm pair 65 so that the movable roller 71 of the curl correcting mechanism 70 is moved by the rotation of the gear. Further, the curl correcting mechanism 70 may be omitted.

The timings for moving the pressing roller 41 of the first contact mechanism 40 and the pressing roller 61 of the second contact mechanism 60 are not limited to those in the above-described embodiment.

In the above-described embodiment, the first and second pressing rollers 41 and 61 are moved by the respective first and second cam motors 93 and 95 driven under the control of the CPU 81. However, the present invention is not limited to that the movements of the first and second pressing rollers 41 and 61 are under the control of the CPU 81. For example, notched gears may be used that drive the first and second pressing rollers 41 and 61 in accordance with the normal and reverse revolutions of the conveyor motor 87 and do not transmit the driving force of the conveyor motor 87 at predetermined rotational positions of the gears.

The conveyor belt 33 may be manually reversed so that the second pressing roller 61 and the movable roller 71 are moved down in accordance with the manual operation.

In the above-described embodiment, the position where the first pressing roller 41 can press the paper 500*a* onto the conveyor belt 33 is opposed to the guide member 37. However, the positional relation may be changed according to circumstances.

In the above-described embodiment, the position where the second pressing roller 61 can press the paper 500*a* onto the conveyor belt 33 is opposed to the belt roller 31. However, the positional relation may be changed according to circumstances.

The first and second contact mechanisms 40 and 60 have the constructions in which the first and second pressing rollers 41 and 61 press the paper 500*a* onto the conveyor belt 33, respectively. However, the present invention is not limited to those. For example, in any of the mechanisms, the paper 500*a* may be brought into close contact with the conveyor belt 33 by air pressure.

The conveyor unit 30 is not limited to the construction in which the paper is conveyed by the conveyor belt 33. For example, the paper 500*a* may be put on a cylindrical drum to convey.

In the above-described embodiment, the cutting mechanism 50 includes the movable and fixed edges 51 and 52. However, the present invention is not limited to this. For example, a so-called rotary cutter that can cut the paper 500*a* with a rotating edge may be used as the cutting mechanism. Further, the printer 10 may include no cutting mechanism. In that case, for example, the paper 500*a* discharged out of the printer 10 may be cut with scissors or the like, in Step S111. Afterward, instructions may be given to the printer 10 through a not-shown input unit to rewind the paper 500*a*.

The roll 500 may be formed by winding the paper 500*a* on a cylindrical core.

The number of heads in the printer is not limited to four. Further, the printer is not limited to a color printer.

The present invention is not limited to inkjet printers. For example, the present invention is applicable also to inkjet type facsimiles and copying machines.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image recording apparatus comprising:

a roll supporter that rotatably supports a roll into which a long record medium has been wound;

a conveyor unit comprising an adhesive conveyor member on which the record medium being unwound from the roll is put, the conveyor unit being capable of conveying the record medium put on the conveyor member in either of a first direction in which the roll is unwound and a second direction reverse to the first direction;

an image recording head that records an image on the record medium put on the conveyor member;

an image recording controller that controls the image recording head to record the image on the record medium being conveyed in the first direction;

a first contact mechanism that can bring the record medium into close contact with the conveyor member at a position distant in the second direction from an image recording position where the image recording head records the image on the record medium; and a second contact mechanism that can bring the record medium into close contact with the conveyor member at a position distant in the first direction from the image recording position, the first contact mechanism bringing the record medium, being conveyed in the first direction, into close contact with the conveyor member, the second contact mechanism bringing a part of the record medium, being conveyed in the second direction, into close contact with the conveyor member, which part was beyond the conveyor member in the first direction when the conveyance direction of the record medium by the conveyor member was switched from the first direction to the second direction.

2. The image recording apparatus according to claim 1, further comprising a contact operation controller that controls operations of the first and second contact mechanisms.

3. The image recording apparatus according to claim 1, further comprising a conveyor controller that controls the conveyor unit to switch over the conveyance direction of the record medium put on the conveyance member between the first and second directions.

4. The image recording apparatus according to claim 1, further comprising a cutter that cuts the record medium at a position distant in the first direction from the conveyor member; and a cutter controller that controls the cutter to cut the record medium, being conveyed in the first direction, at a desired position.

5. The image recording apparatus according to claim 4, wherein the second contact mechanism comes to a position where it can bring the record medium into close contact with the conveyor member before the record medium starts to be conveyed in the second direction after cutting by the cutter is completed.

6. The image recording apparatus according to claim 1, wherein the first contact mechanism comes to a position where it can bring the record medium into close contact with the conveyor member before an end of the record medium in the first direction reaches the position where the first contact mechanism can bring the record medium into close contact with the conveyor member.

7. The image recording apparatus according to claim 1, wherein the first contact mechanism is distant from the record medium and the conveyor member when the record medium is conveyed in the second direction.

8. The image recording apparatus according to claim 7, wherein the first contact mechanism starts to move in a direction distant from the record medium and the conveyor member before the record medium starts to be conveyed in the second direction after the conveyance of the record medium in the first direction is completed.

9. The image recording apparatus according to claim 1, wherein the second contact mechanism comes to a position where it can bring the record medium into close contact with the conveyor member before the record medium starts to be conveyed in the second direction after the conveyance of the record medium in the first direction is completed.

10. The image recording apparatus according to claim 1, wherein the second contact mechanism is distant from the record medium and the conveyor member when the record medium is conveyed in the first direction.

11. The image recording apparatus according to claim 10, wherein the second contact mechanism starts to move in a direction distant from the record medium and the conveyor member before the record medium starts to be conveyed in the first direction after the conveyance of the record medium in the second direction is completed.

12. The image recording apparatus according to claim 1, wherein the first contact mechanism comprises a first pressing member that can be selectively at a position where it can press the record medium onto the conveyor member and at a position where it is distant from the record medium and the conveyor member.

13. The image recording apparatus according to claim 1, wherein the first contact mechanism comprises:

a first pressing roller that can press the record medium onto the conveyor member;

a first arm that rotatably supports the first pressing roller;

a first biasing member that is biasing the first arm such that the first pressing roller can get near to the conveyor member; and a first rotating member that can be selectively at a position where it is in contact with the first arm and can move the first arm so that the first pressing roller is distant from the record medium and the conveyor member, and at a position where it in distant from the first arm.

14. The image recording apparatus according to claim 1, wherein the second contact mechanism comprises a second pressing member that can be selectively at a position where it can press the record medium onto the conveyor member and at a position where it is distant from the record medium and the conveyor member.

15. The image recording apparatus according to claim 1, wherein the second contact mechanism comprises:

a second pressing roller that can press the record medium onto the conveyor member;

a second arm that rotatably supports the second pressing roller;

a second biasing member that is biasing the second arm such that the second pressing roller can get near to the conveyor member; and a second rotating member that can be selectively at a position where it is in contact with the second arm and can move the second arm so that the second pressing roller is distant from the record medium and the conveyor member, and at a position where it is distant from the second arm.

16. The image recording apparatus according to claim 15, further comprising a curl correcting mechanism at a position distant in the first direction from the second contact mechanism, the curl correcting mechanism comprising:

a movable roller disposed so as to be opposed to one face of the record medium;

a fixed roller having an axis of rotation parallel to an axis of rotation of the movable roller, the fixed roller being disposed so that an outer circumferential surface of the fixed roller can come into contact with the other face of the record medium; and a third arm that rotatably supports the movable roller, the third arm moving the movable roller toward the fixed roller attendant upon an action of the second arm.

17. The image recording apparatus according to claim 16, wherein the third arm is formed integrally with the second arm.

18. The image recording apparatus according to claim 16, wherein the movable roller is at a position where the movable roller can cooperate with the fixed roller to pinch the record medium when the second roller is at a position where the second roller can press the record medium onto the conveyor member.

19. The image recording apparatus according to claim 16, wherein the movable roller is made of a plastic material and the fixed roller is made of an elastic material.

20. The image recording apparatus according to claim 1, further comprising a shock absorbing mechanism that absorbs a shock to the record medium.

21. The image recording apparatus according to claim 20, wherein the shock is caused by a sharp change in tension on the record medium.

22. The image recording apparatus according to claim 20, wherein the shock absorbing mechanism comprises a tensioner disposed between the roll and the conveyor unit so as to apply a tension to the record medium.

23. The image recording apparatus according to claim 22, wherein the tensioner comprises:

a tension roller disposed so that an outer circumferential surface of the tension roller can come into contact with a back face of the record medium; and a roller supporting member that supports the tension roller so that the tension roller can be rotatable and elastically displaceable.

24. The image recording apparatus according to claim 22, wherein the tensioner comprises:

a tension roller disposed so that an outer circumferential surface of the tension roller can come into contact with a back face of the record medium; and a roller supporting member that supports the tension roller so that the tension roller can be rotatable and swingable.

25. The image recording apparatus according to claim 20, wherein the shock absorbing mechanism comprises a roll supporting mechanism that supports the roll so that the roll can be rotatable and elastically displaceable.

26. The image recording apparatus according to claim 20, wherein the shock absorbing mechanism comprises a roll supporting mechanism that supports the roll so that the roll can be rotatable and swingable.

27. The image recording apparatus according to claim 26, wherein the roll supporting mechanism comprises:

a supporting roller disposed within a hollow in the roll so as to rotatably support the roll; and a roller supporting member that supports the supporting roller so that the supporting roller can be rotatable and elastically displaceable.

28. The image recording apparatus according to claim 26, wherein the roll supporting mechanism comprises:

a supporting roller disposed within a hollow in the roll so as to rotatably support the roll; and a roller supporting member that supports the supporting roller so that the supporting roller can be rotatable and swingable.

* * * * *